United States Patent [19]

Kito et al.

[11] 4,340,357

[45] Jul. 20, 1982

[54] INFRARED RADIATION GAS BURNER PLATE

[75] Inventors: Michimasa Kito; Toshiyuki Nomura, both of Nagoya, Japan

[73] Assignee: Rinnai Kabushiki Kaisha Rinnai Corporation, Nagoya, Japan

[21] Appl. No.: 78,703

[22] Filed: Sep. 25, 1979

[30] Foreign Application Priority Data

Sep. 29, 1978 [JP] Japan ..... 53-119285

[51] Int. Cl.[3] ..... F23D 13/12

[52] U.S. Cl. ..... 431/328

[58] Field of Search ..... 431/328, 329, 326, 327

[56] References Cited

U.S. PATENT DOCUMENTS

| | | | |
|---|---|---|---|
| 3,179,155 | 4/1965 | Partiot | 431/328 |
| 3,291,188 | 12/1966 | Partiot | 431/328 |
| 3,558,252 | 1/1971 | Roca | 431/328 |
| 3,751,213 | 8/1973 | Sowards | 431/328 |
| 3,825,403 | 7/1974 | Gottschall | 431/329 |
| 3,954,387 | 5/1976 | Cooper | 431/328 |

FOREIGN PATENT DOCUMENTS

| | | | |
|---|---|---|---|
| 1408445 | 7/1965 | France | 431/328 |
| 2223631 | 10/1974 | France | 431/328 |
| 237321 | 11/1969 | U.S.S.R. | 431/328 |

*Primary Examiner*—Samuel Scott
*Assistant Examiner*—Lee E. Barrett
*Attorney, Agent, or Firm*—Armstrong, Nikaido, Marmelstein & Kubovcik

[57] ABSTRACT

This invention relates to an infrared radiation gas burner plate of the type that a plate member composed chiefly of ceramic is provided with a large number of distributed burner holes therethrough.

4 Claims, 4 Drawing Figures

INFRARED RADIATION GAS BURNER PLATE

The present invention relates to infrared radiation gas burner plates, and particularly to such plates that the plate member is composed chiefly of ceramic and is provided with a large number of burner holes distributed in a claimed fashion therethrough.

Burners of the prior art of this general type are characterized by several deficiencies. Some are such that the time required for increasing the temperature is too long. Others lack the proper radiant efficiency. In other instances prior art burners are characterized by a loud burning noise which, of course, is undesirable. Furthermore, some burners of the prior art are unstable, especially under changes of pressure of supply gas or other variations in ambient conditions.

An object of the present invention is a new and improved radiation gas burner plate such that the burner, based upon the same, is characterized by the capability of rapid increase in temperature.

A further object is an infrared radiation gas burner plate such that the radiant efficiency of the burner is improved. An additional object is a burner having an improved burner plate so characterized as to prevent any substantial burning noise.

Another object is such a burner plate as to maintain stability in the operation of the burner, even under changes in pressure of supply gas or any other change of ambient conditions.

Additional objects will be appreciated from the following description of the invention.

In accordance with this invention, the burner includes a burner plate of the type such that the plate member, composed chiefly of ceramic, is provided with a large number of distributed burner holes therethrough; plural ribs are provided, each of which is nearly V-shaped in section, and comprises a linear ridge and a pair of slants of both sides of the ridge, said ribs being provided in parallel, one with another, on the obverse surface of the plate member, and each valley formed between mutually opposite slants of each adjacent pair of the ribs being formed into a groove of nearly channel-shaped cross-section, the foregoing burner holes being arranged to be composed of plural central burner holes disposed in a line in each groove, and respective four peripheral burner holes surrounding each center burner hole, and being disposed on mutually opposite slants on both sides of the central burner hole. These burner holes on both sides of each ridge are so arranged as to be differentiated in phase.

The invention will be more readily understood by referring to the various figures of the drawing.

Figure 1:
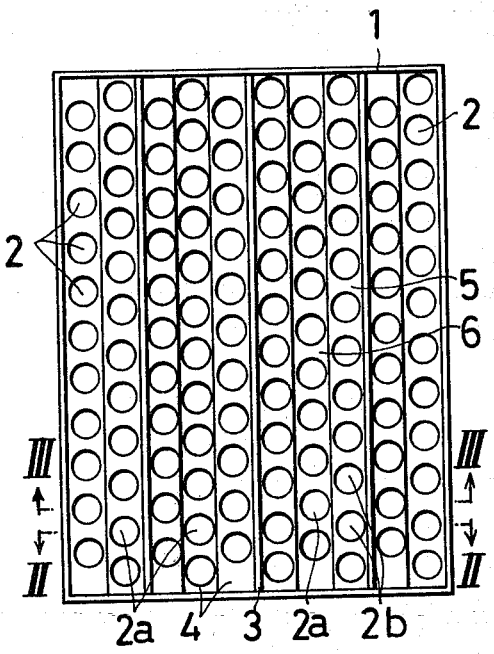
FIG. 1 is a front view of the burner plate.

Referring in detail to the various figures of the drawing, Numeral 1 denotes a plate member composed chiefly of ceramic, and the same is provided with a large number of distributed burner holes 2 made therethrough so as to produce a burner plate.

Figure 4:
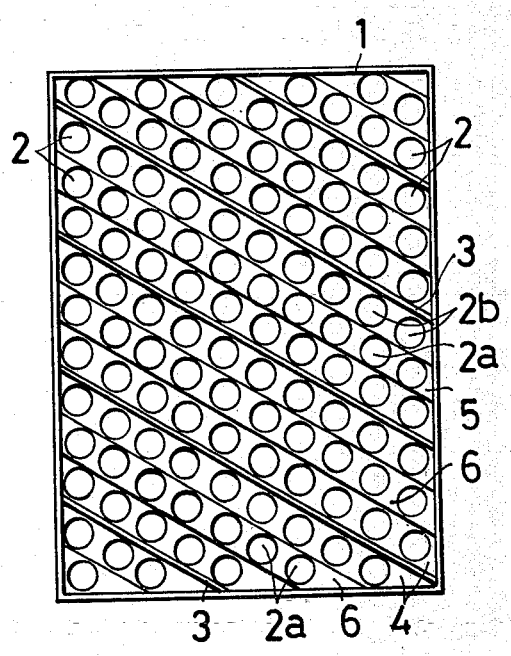
FIG. 4 is a front view of one type of burner plate.

According to this invention, in this type of burner plate, plural ribs 5, each of which is nearly V-shaped in section and comprises a linear ridge 3 and a pair of slants 4, 4 on both sides of the ridge 3 are provided in parallel one with another on the obverse surface of the plate member 1, and each valley formed between mutually opposite slants 4, 4 of each adjacent pair of the ribs 5, 5 is deepened to form a groove 6 of nearly channel-shaped in section. In this case, optionally, the ribs 5 and the grooves 6 may be in parallel with both side edges of the rectangular plate member 1 as shown, for instance, in FIG. 1 or may be oblique thereto as shown, for instance, in FIG. 4.

The foregoing burner holes 2 are composed of central burner holes **2*a* and peripheral burner holes 2*b* as described, in detail, hereinafter. Namely, there are disposed in a line in each groove 6 plural central burner holes 2*a*, and there are disposed in the opposite slants 4, 4 on both sides of each center burner hole 2*a* respective to peripheral burner holes 2*b*, 2*b* and 2*b*, 2*b*, that is, four in total. In this case, it is so arranged that the burner holes 2*a*, 2*b* on one side of each ridge 3 and the burner holes 2*a*, 2*b*** on the other side thereof are differentiated in phase by a half pitch.

Figure 2:
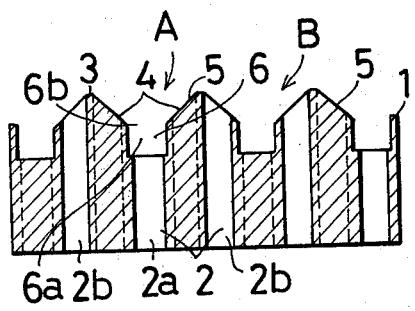
FIG. 2 is a sectional view taken along the lines II—II of FIG. 1.
Figure 3:
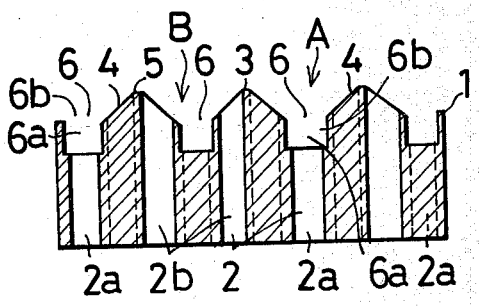
FIG. 3 is a sectional view of the burner plate taken along the lines III—III in FIG. 1.

Consequently, there is formed in the burner plate 1 such a long zone that, as shown clearly in FIGS. 2 and 3, a first section A in which there is the central burner hole **2*a* in the groove 6 but there is no peripheral burner holes 2*b*, 2*b* in the mutually opposite slants 4, 4 and a second section B in which there is no central burner hole 2*a* in the groove 6 but there is the peripheral burner holes 2*b*, 2*b* in the mutually opposite slants 4, 4** are disposed alternately in the longitudinal direction of the long zone, and such long zones as above are disposed side by side and are differentiated in phase.

The operation of the burner plate will now be explained as follows:

Gas is so supplied to the reverse surface of the plate member 1 as to gush out through each burner hole 2 and be burned over the obverse surface thereof. This is not especially different from the conventional one. In this invention, however, if the first section A is now taken into consideration, the groove 6 serves as a false burner hole at that section. Namely, if the gas is quick in inflammability, the gas is burned at a bottom portion **6*a* in the groove 6. If the gas is slow in inflammability, the gas is burned at an open portion 6*b* over the upper surface of the groove 6. Thus, in any case, the gas is always burned at the groove 6 serving as the false burner hole. In other words, the groove 6 is adaptable for any change in gas pressure. Furthermore, due to this gas distribution, the burning area is increased. If, next, the second section B is taken into consideration, the gas is burned at a space formed between the right and the left slants 4, 4 and consequently a comparatively wide burning area is given. Consequently, the burning at every section B compensates a dark portion at every section A adjacent thereto and, as a result, the entire obverse surface of the burner plate 1 becomes red-hot quickly and a uniform red-hot burning is resulted. Furthermore, an eddy and a pressure change caused thereby which become a cause of a burning noise are distributed in the longitudinal direction in the groove 6**, resulting in remarkable decrease in generation of the burning noise.

According to the Inventors' experiments, it has been confirmed that it is optimum that the size of each burner hole 2 is about 1 mm in diameter regardless of kinds of gases, and it is desirable that the depth of each groove 6 is half the same or more, that is, 0.5 mm or more.

Thus, according to this invention, the burner holes are composed of a combination of the central burner holes in each groove and the peripheral burner holes disposed around the same and on the mutually facing slants, so that there can be always obtained a stable burning condition regardless of change in gas pressure or change in gas kind, and there can be obtained a quick red-hot and a uniformity thereof, and there is no generation in a burning noise, and it is simple in construction and can be obtained economically.

It will be appreciated that many variations may be made without departing from the scope of the present invention. Accordingly, we intend to be bound only by the following patent claims.

We claim:

1. An infrared radiation gas burner plate of the type that a plate member composed chiefly of ceramic is provided with a large number of distributed burner holes made therethrough, characterized in that plural ribs, each of which is nearly V-shaped in section and comprises a linear ridge and a pair of slants on both sides of the ridge, are provided in parallel one with another on the obverse surface of the plate member, and each valley formed between mutually opposite slants of each adjacent pair of the ribs is formed into a groove of nearly channel-shaped in section, and the foregoing burner holes are arranged to be composed of plural central burner holes disposed in a line in each groove, and respective four peripheral burner holes surrounding each central burner hole and disposed in the opposite slant of both sides of the central burner hole, and these burner holes on both outsides of each ridge are so arranged as to be differentiated in phase.

2. An infrared radiation gas burner plate as claimed in claim 1, wherein the ribs and the grooves are in parallel with the side edge of the plate member.

3. An infrared radiation gas burner plate as claimed in claim 1, wherein the ribs and the grooves are oblique to the side edge of the plate member.

4. An infrared radiation gas burner plate as claimed in any one of claims 1, 2 or 3, wherein each burner hole is about 1 mm in diameter, and each groove is 0.5 mm or more in depth.

* * * * *